US010793243B2

(12) United States Patent
Skrydstrup et al.

(10) Patent No.: US 10,793,243 B2
(45) Date of Patent: Oct. 6, 2020

(54) FOLDABLE PROPELLER AND METHOD FOR ASSEMBLY

(71) Applicant: Flexofold ApS, Vejle (DK)

(72) Inventors: Jack Skrydstrup, Egtved (DK); Ulrik Nielsen, Silkeborg (DK)

(73) Assignee: Flexofold ApS, Vejle (DK)

( * ) Notice: Subject to any disclaimer, the term of this patent is extended or adjusted under 35 U.S.C. 154(b) by 175 days.

(21) Appl. No.: 16/011,795

(22) Filed: Jun. 19, 2018

(65) Prior Publication Data

US 2019/0135395 A1 May 9, 2019

(30) Foreign Application Priority Data

Jun. 19, 2017 (DK) ..... 2017 70477

(51) Int. Cl.
*B63H 1/22* (2006.01)

(52) U.S. Cl.
CPC ..... *B63H 1/22* (2013.01)

(58) Field of Classification Search
CPC ..... B63H 1/22
USPC ..... 416/142
See application file for complete search history.

(56) References Cited

U.S. PATENT DOCUMENTS

| | | | | |
|---|---|---|---|---|
| 5,183,384 | A | 2/1993 | Trumbly | |
| 5,403,217 | A | 4/1995 | Vosper | |
| 10,214,269 | B2 * | 2/2019 | Skrydstrup | B63H 1/22 |
| 10,569,850 | B2 * | 2/2020 | Shaw | C23F 13/06 |

FOREIGN PATENT DOCUMENTS

| | | | |
|---|---|---|---|
| WO | 9106468 | A1 | 5/1991 |
| WO | 9715489 | A1 | 5/1997 |
| WO | 9719849 | A1 | 6/1997 |
| WO | 2015055210 | A1 | 4/2015 |

* cited by examiner

*Primary Examiner* — Woody A Lee, Jr.
*Assistant Examiner* — Jason G Davis
(74) *Attorney, Agent, or Firm* — James Creighton Wray

(57) ABSTRACT

The present invention relates to a foldable propeller (1) for a boat, e.g. for a sailboat or a multihull yacht, where the foldable propeller (1) comprises a hub (2) with a plurality of blades, each blade comprising a blade root arranged to pivot around a separate pivot pin in order to be either in a first operative orientation, where the blade (4) is pointing mainly in a radial direction, or in a second inoperative orientation, where the blade is pointing mainly in an axial direction. The hub (2) comprises a number of hub flanges (28) for holding the pivot pins (9). The pivot pin (9) comprises at its second end (21) a head (26) with a recess (24) that accommodates the first end (20) of another of the pivot pins (9) inside the head (26).

14 Claims, 8 Drawing Sheets

FOLDABLE PROPELLER AND METHOD FOR ASSEMBLY

FIELD OF THE INVENTION

The present invention relates to a foldable propeller for a boat, e.g. for a sailboat or a multihull yacht, where the foldable propeller comprises a hub for fastening at a drive-shaft connected to a motor, where the foldable propeller further comprises a plurality of individual blades, where each of the blades comprises a blade root arranged to pivot around a separate pivot pin at the hub in order to be either in a first and operative orientation, where the blade is pointing mainly in a radial direction, or in a second and inoperative orientation, where the blade is pointing mainly in an axial direction.

BACKGROUND OF THE INVENTION

It is well known that boats such as sailboats and multihull yachts use foldable propellers in order to minimise drag, noise and wear when sailing without use of a motor. Examples are disclosed in U.S. Pat. No. 5,183,384, WO91/06468, and WO97/19849.

Using a foldable propeller prevents the propeller from being rotated by the water and reduces drag and noise when sailing without motor. Furthermore, there is less tendency for the propeller to get tangled up in fishing lines and rope.

Another rather important issue when it comes to propellers for boats is corrosion and effectiveness. Galvanic corrosion can be limited by using sacrificial anodes that will be corroded instead of the propeller hub and blades. Another important subject is the effectiveness of the propeller, which can be compromised rather drastically due to fouling on the propeller parts. Until now the design of foldable propellers did not address the problem with fouling very well.

WO2015/055210 describes a foldable blade propeller, comprising three blades, where the foldable propeller is corrosion resistant, has a low moment of inertia, and where slack between the individual parts of the foldable propeller can be adjusted according to production tolerances and to wear. Further, a foldable propeller is described, where the mechanism for taking up the forces acting on the propeller when operated, comprises a closed mechanical system allowing for the use of a low tensile strength material for parts of the propeller.

U.S. Pat. No. 5,403,217 describes another foldable blade propeller for a power vessel, wherein the foldable blade propeller comprises a hub for directly or indirectly mounting on a driving shaft, where the foldable blade propeller further comprises at least two propeller blades, where each of the propeller blades comprises a base arranged to turn around each own pivot pin at the mentioned hub for in that way to be in either a first operative orientation, where the propeller blades are pointing in a mainly radial direction, or to be in another and inoperative orientation, where the propeller blades are pointing in a mainly axial direction, and where the mentioned hub comprises one or several slots for the mentioned bases and a first set of holes for inserting of pivot pins.

Although, the prior art has been subject to development, there is still a steady aim to improve existing systems and create stable structures that are easily assembled.

DESCRIPTION OF THE INVENTION

It is an objective of the invention to provide an improvement in the art. Especially, it is an objective to provide an improved foldable propeller for boats, in particular a propeller that is easy to assemble and has a high degree of stability. It is a further objective to provide a foldable propeller with few components.

The objective is achieved with a foldable propeller as explained in the following.

The foldable propeller is useful for a boat, e.g. for a sailboat or a multihull yacht. The foldable propeller comprises a hub for directly or indirectly fastening to a drive-shaft that is connected to a motor. The drive shaft is defining a rotation axis for the propeller.

The foldable propeller further comprises a plurality of individual blades, typically two, three or four blades. Each of the blades comprises a blade root arranged to pivot around a separate pivot pin in the hub in order for the blades to be either in a first or second orientation, where the first orientation is an operative orientation where the blades are extending from the blade root in a radial direction from the hub lateral to the rotation axis, and wherein the second orientation is an inoperative orientation where the blades are pointing mainly in an axial direction, parallel or largely parallel with the rotational axis.

The hub comprises a plurality of hub flanges, one for each blade, with a slot in between neighbouring hub flanges, where each slot is accommodating one of the blade roots. The hub flanges are also holding the pivot pins for the blades.

Each pivot pin comprises a stem between the first end and the second end. When mounted, the stem extends through an aperture in the blade root with the aperture being mounted pivotal about the stem.

Each hub flange comprises a hole in which a first end of one of the pivot pins is accommodated and an aperture in which a second end, or at least part of a second end, of another of the pivot pins is accommodated, such that each pivot pin extends from one of the hub flanges to another of the hub flanges.

Typically, the pivot pins are oriented in a plane perpendicular to the rotation axis of the propeller.

For example, the pivot pins are connected to each other to form a polygon. For a three blade propeller, the corresponding three pivot pins form a triangle in cooperation. For a four blade propeller, the corresponding four pivot pins form a square. The triangle or square is oriented in a plane perpendicular to the rotation axis of the propeller. It is pointed out that the propeller, in principle, can have more than four blades.

The pivot pin comprises at its second end a head with a recess that accommodates the first end of another of the pivot pins inside the head.

In a practical embodiment, each of the pivot pins comprises at its second end a portion that is dimensioned larger than the first end, the portion forming a head with a recess that accommodates the first end of another of the pivot pins inside the head. For example, the head and the stem are formed as a single integral piece. The term single integral piece means that the head and the stem are not configured for disassembly from each other. For example, for separating the head from the stem, destructive cutting or sawing would have to be used.

Advantageously, the first end has a cross section that is equal to or smaller than a cross section of the stem. In this case, the first end can be pushed through the aperture in the blade root for insertion into the hub.

For installation of the foldable propeller, a first of the pivot pins is inserted with its first end from an outer side of a first of the hub flanges into and through the aperture of the first hub flange. While the blade root is positioned with its blade root aperture inside the slot between the first hub flange and a second of the hub flanges, the method comprises pushing the first end of the pivot pin through the blade root aperture of the root blade and across the slot into the hole of the second hub flange. The procedure is repeated for the remaining blades and pivot pins. The head of each pivot pin after insertion accommodates the first end of another of the pivot pins.

Optionally, locking members are used to hold the arrangement in place, for example one locking member for each pivot pin. An example of such locking member is a cross dowel. For example, the cross dowel is cylindrical with a longitudinal axis, optionally arranged parallel with the rotation axis of the propeller, and a threaded hole into or through the cross dowel for cooperation with a locking screw.

For stable mounting, in some embodiments, a cross dowel is provided at each head. For example, a cross dowel is arranged inside each vertex of the equilateral triangle or square shaped by the pivot pins when installed.

For example, during assembly, a cross dowels is mounted along a concavity, typically cylindrical concavity, in each of the heads, where the concavity is stabilising the cross dowel. Optionally, a locking screw is mounted through a hole in each of the heads and into the corresponding threaded hole of the cross dowel and tightened for a stable configuration. Optionally, the hub comprises holes arranged parallel to the rotational axis of the hub.

The stem of each pivot pin has an outer side facing outwards from the rotational axis of the propeller and an opposite inner side facing the rotational axis of the propeller. Optionally the inner side at the first end comprise a first concavity, which is abutting a first side of a cross dowel for stabilization. As a further option, each head comprises a second concavity, which is abutting a second side of the cross dowel. While accommodated between the first concavity and second concavity, for example arranged opposite to each other, movements of the cross dowel perpendicular to a longitudinal axis of the cross dowel are prevented. As the cross dowels are supported in a radial direction by the hub end cap, the hub end cap become part of the structural stabilising arrangement and contribute to transferring the loads acting on the foldable propeller when in use.

For example, the recess in the head comprises an abutment cavity abutting the outer side of the pivot pin and holding the concavity of the inner side of the pivot pin against the cross dowel.

Optionally, the first end of the pivot pin is slanted at an acute angle relatively to the stem in order for the outer side of the stem being longer than the inner side of the stem. This embodiment is an optional technical solution for giving passage-space for the stem of another of the pivot pins during insertion of the pivot pins one after the other in the hub. This is useful, in particular, for a triangular assembly of the pivot pins.

In some embodiments, the pivot pin at its first end comprises a first part of a notched interlock, and the recess in the head comprises an abutment cavity comprising a second part of a notched interlock. When a plurality, for example three or four, pivot pins are assembled, for example into a triangle or square, respectively, such that the abutment cavity is abutting the outer side of the pivot pin, the first part and the second part cooperate in the abutment cavity such as to form the notched interlock with at least one recess and at least one notch in cooperation in the abutment cavity. For example, the at least one recess and notch are formed as interlocking barb-shaped ribs.

As an alternative to embodiments with cross-dowels, the head comprises a hole extending through the head for a locking screw, and the first part of the pivot pin comprises a corresponding hole with the threading for receiving the thread of the locking screw when it extends through the hole.

Optionally, the hub comprise a galvanic anode, for example installed at a hub end cap using a suitable fastening means, e.g. a screw that engages a threaded hole in the hub end cap. The hub end cap may be installed at the end of the hub, for example using screws that engage threaded holes in the hub. Such screws may at the same time engage the above mentioned cross dowels, for example arranged in the vertex of the equilateral triangle or square. This way, the cross dowels have two functions, firstly to support and secure the pivot pins and secondly to serve as a mounting interface for the hub end cap.

Yet another advantage of the hub end plate carrying a galvanic anode is that the hub end plate and the cross dowels or screws act as electrical connecting members that allow the galvanic anode to work and protect the metal parts of the hub and especially the blades and the blade roots from galvanic corrosion.

In a variant of a foldable propeller, each blade has a blade root comprising a gear engaging one or more other gears at other blade roots. Using gears at the blade root of the propeller blades secures a simultaneous engagement of all propeller blades when engaging the drive shaft. The propeller blades are forced into the operative orientation by the radial forces from the rotation. By using the gears, it is safeguarded that all blades are activated in an equal manner which results in the foldable propeller being in optimum balance. A foldable propeller, according to the invention, may however be designed with blades without such a gear.

A foldable propeller as described having a plurality of blades, for example two, three, or four blades, will typically have blades manufactured from a metal alloy comprising Ni, Al, Cu, bronze and/or other copper and stainless steel alloys that will be suitable for this purpose.

Optionally, also the hub is manufactured from a metal alloy. Alternatively, it is made from metal, optionally steel.

Alternatively, the hub is manufactured from a plastic material, e.g. Polyoxymethylene (POM, polyacetal), polyethylene terephthalate (PET, polyester), polyamide (PA). Other types of polymers and thermosetting materials with suitable properties may also be used for the hub. Optionally, the plastic material is fibre reinforced. Examples of useful fibres are fibres made from glass, carbon, synthetic fibres, or metal fibres. A hub made from plastics has the advantage of being an electrical insulator preventing or at least minimising corrosion of the metal parts of the hub. Furthermore, plastic is often a low-cost material that is easy to machine and strong enough to transfer the torque of the motor. A hub made from a polymer also has a considerably lower weight and thus also less inertia when rotating and especially when changing between forward and reverse rotation of the propeller, which is one of the situations where the prior art foldable propellers experience a high load due to a relatively high weight of the hub itself.

DESCRIPTION OF THE DRAWING

The invention will now be described in more detail, by way of example, with reference to the accompanying drawings, in which.

In the following, similar components in different figures will be numbered with the same reference numbers. Not all components indicated in a specific figure will be discussed for each of the figures.

REFERENCE NUMBER LIST

Figure 1:
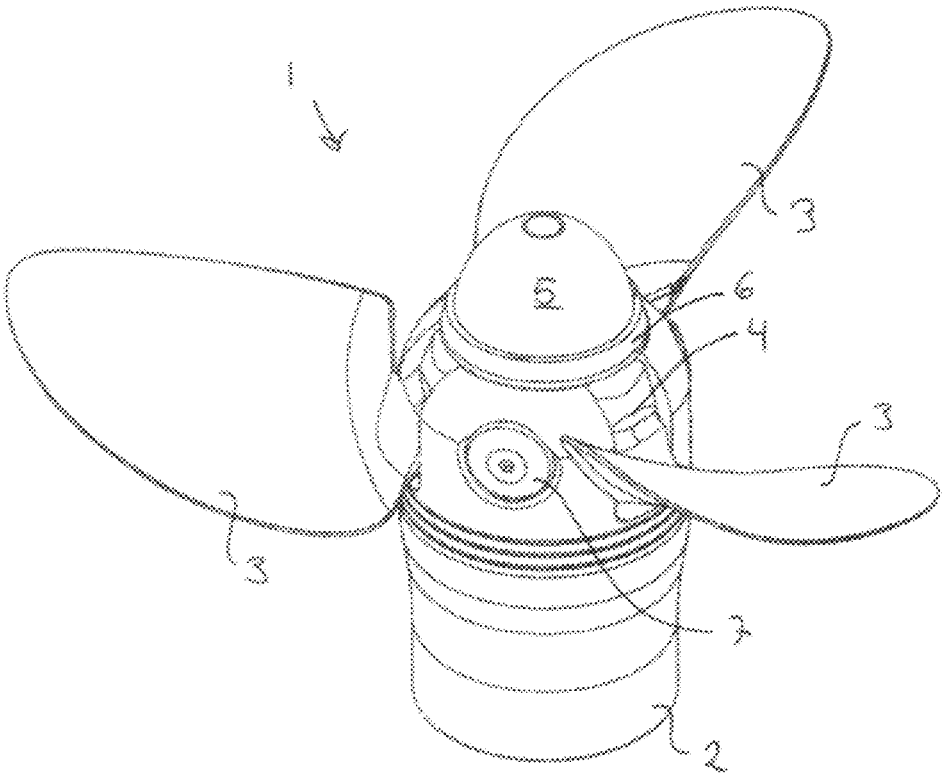
FIG. 1 shows a three bladed foldable propeller in an operative orientation.

1. Foldable propeller
2. Hub
3. Blade
4. Blade root
5. Anode
6. Hub end cap
7. Lockbox
8. Gear at blade root
9. Pivot pin
10. Hole in hub flange 28 for pivot pin 9
11. Concavity for cross dowel
11' Concavity in head 26
12. Cross dowel
13. Threaded hole in side of cross dowel
14. Locking screw
15. Hole in hub flange 28 for cross dowel 12
16. Aperture
17. Hole in lockbox flange
18. Flange at lockbox
19. Slot in hub for propeller blade roots
20. First end of pivot pin
21. Second end of pivot pin
22. Engagement means at pivot pins
23. Surface at pivot pin ends
24. Pivot pin recess in head 26 at second end 21 of pivot pin 9 for receiving first end
20 of neighbouring pivot pin 9
24' Abutment cavity in recess 24
24" bottom of pivot pin recess
25. Recess for receiving the head of the locking screw 14
26. Head of pivot pin 9 at second end 21
27. Hole in head 26 at second end 21 of pivot pin 9
28. Hub flange
29. Stem of pivot pin 9
30. Aperture in blade root 4
31. Inner side of the pivot pin 9
32. Outer side of pivot pin 9
33. Threaded hole in top of cross dowel
34. Screws engaging with threaded hole 33
35. Notched interlock
A: First part of the interlock B: Second part of interlock
36. Hole at first end 20 of pivot pin 9 for screw 14
36' Threading in hole 36
37. Screw for fastening anode 5
38. Thread in hub end cap 6 for screw 37
39. Apertures in hub end cap 6 for screws 34'
40. Longitudinal axis of the pivot pin 9

DETAILED DESCRIPTION OF THE INVENTION

Figure 2:
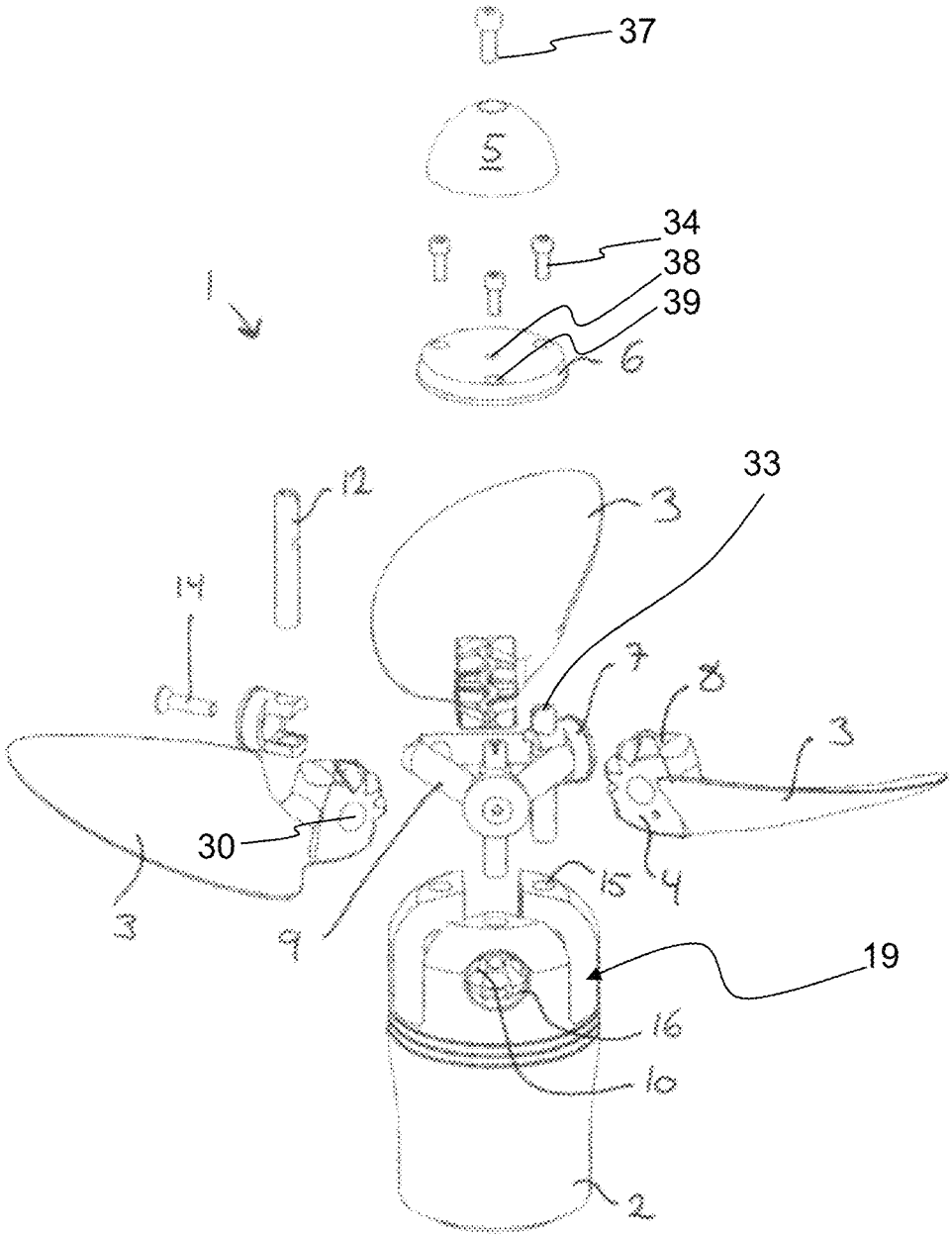
FIG. 2 shows a three bladed foldable propeller in an exploded view.
Figure 3:
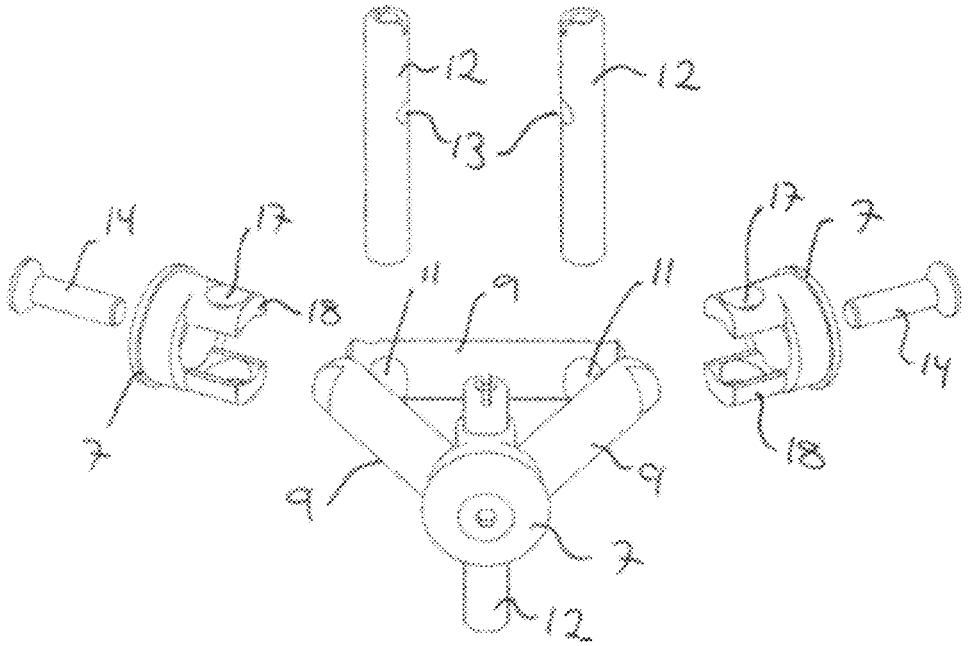
FIG. 3 shows three pivot pins arranged in a triangle.

FIG. 1-3 shows a propeller with foldable blades.

FIG. 1 is a perspective view of the propeller 1 in an operative orientation, where the hub 2 holds the blades 3 in an unfolded orientation and the blades extend in a radial direction from the hub 2. The blades 3 are fastened to the hub 2 at the blade roots 8. At a hub end cap 6 at the end of the hub 2, an anode 5 is provided. On the side of the hub 2 a lockbox 7 is installed through each of three hub flanges.

FIG. 2 shows the same prior art three bladed foldable propeller 1 as seen in FIG. 1, but in exploded view. In this figure the gears 8 at the blade roots 4 are seen, which safeguards that all three blades 3 engage synchronized. Further, the pivot pins 9 are provided in a triangular structure when inserted into the holes 10 in the hub 2.

FIG. 3 shows the same triangular pivot pin structure as seen in FIG. 2 and in a partly assembled state. Near the vertex of the triangle formed by the pivot pins 9, a cross dowel 12 is accommodated between two opposed concavities 11 in the pivot pins 9. The cross dowel 12 has a threaded hole 13 for receiving a locking screw 14. The locking screw 14 is inserted through a central hole in the lockbox 7. The pivot pins 9 are installed in the holes 10 through the aperture 16 which functions as a lockbox seat.

Each cross dowels 12 is installed in a mating hole 15 at the hub 2, as illustrated in FIG. 2. During insertion into the mating hole 15, while the lockboxes 7 are in place in the hub 2, the cross dowels 12 further extend through holes 17 in lockbox flanges 18 of the lockboxes 7. This arrangement secures the triangular pivot pin structure and the blade roots 4 in the slots 19 in the hub 2 in a very solid manner.

As illustrated in FIG. 2, the anode 5 is installed at the hub end cap 6 using a screw 37 that engages a threaded hole 38 in the hub end cap 6. The hub end cap 6 is installed at the hub 2 using screws 34 that extend through corresponding apertures 39 in the hub end cap 6 and engage in threaded holes 33 in the ends of the cross dowels 12. Optionally, on the lower side of the hub end cap 6, a recess at each threaded hole 39 is arranged, where each recess (not shown) is configured for receiving the end of a cross dowel 12. This way, the cross dowels 12 are supported by the hub end cap 6 and the hub end cap 6 becomes a part of the structural arrangement and contributes in transferring the loads acting on the foldable propeller 1 when in use.

The pivot pins 7 have their respective first ends and second ends arranged in a triangular shape, where the ends of two pivot pins are arranged adjacent each other. The respective ends are shaped with engagement members for engagement with a lockbox 7.

Figure 4A:
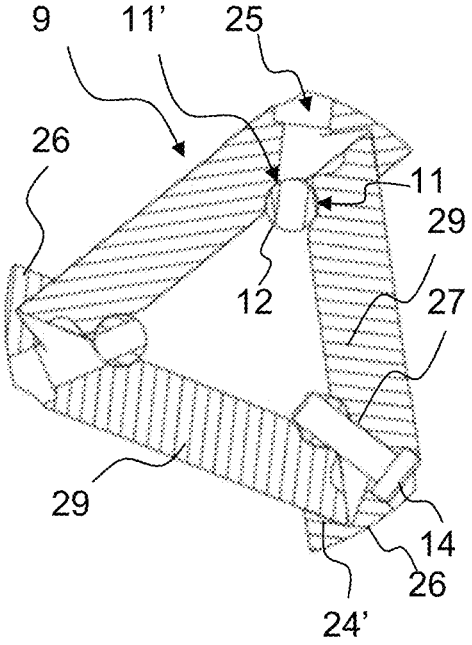
FIGS. 4*a* and 4*b* show an alternative triangular arrangement of pivot pins in a) a cross sectional view and b) a perspective shaded view.
Figure 4B:
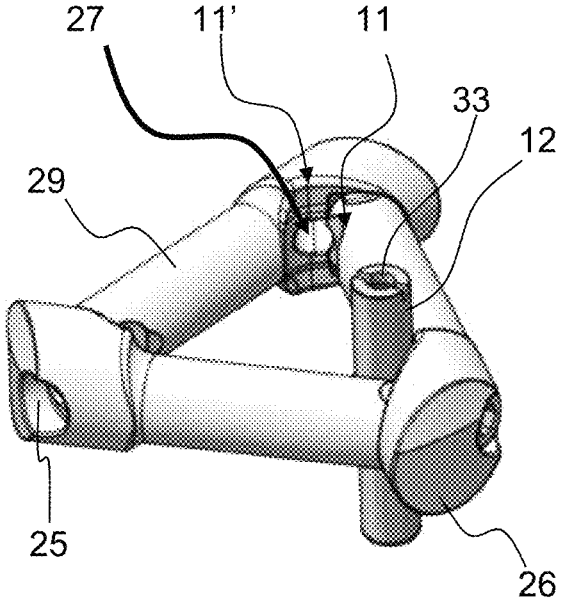

A simplification is achieved in the embodiment as illustrated in FIGS. 4 and 5. In this embodiment, the pivot pins 7 have a first end 20 and a second end 21 and a stem 29 therein between. At the second end 21, there is provided a portion that is dimensioned larger than the first end 20, the portion forming a head 26 and comprises a pivot pin recess 24 for accommodating the first end 20 of a neighboring pivot pin 9 inside the head 26 when the pivot pins 9 are combined into a triangle, as illustrated in FIG. 4. The head 26 and the stem 29 are formed as a single integral piece, for example moulded or machined as a single piece.

Once assembled into a triangle, a locking screw 14 extends through a corresponding hole 27 in the head 26 at the second end 21 and is fastened into the threaded hole 13 in a cross dowel 12. The head of the locking screw 14 is accommodated in recess 25 in the head 26 at the second end 21 of the pivot pin 9.

Figure 5A:
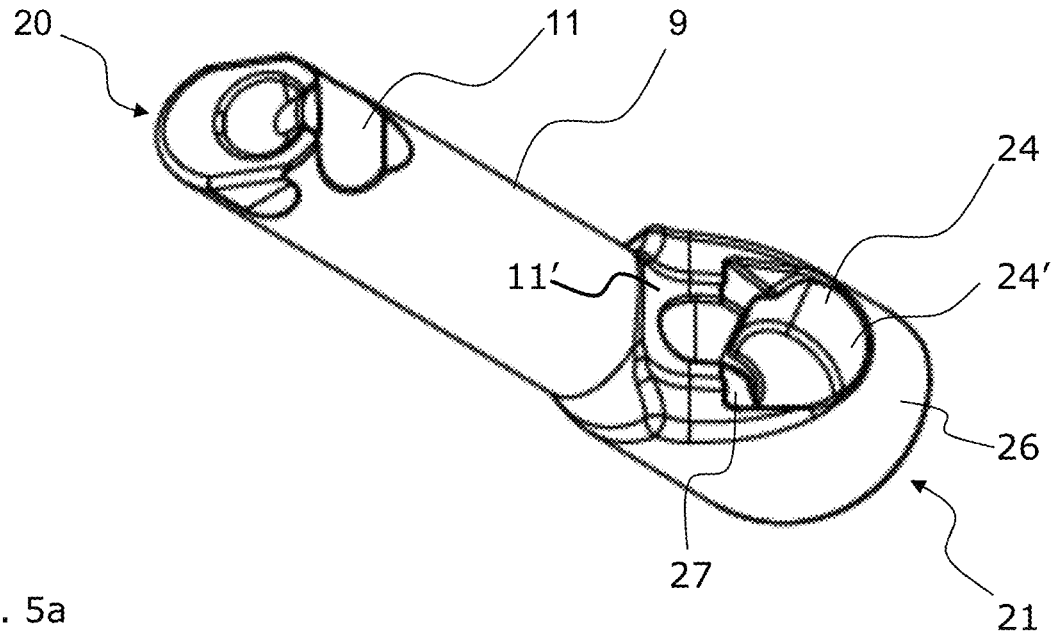
FIGS. 5*a, b, c* and *d* show an embodiment of a pivot pin in greater detail, where a) is a perspective view, b) a side view towards the outer side, c) a side view towards the inner side, and d) a cross sectional view.
Figure 5B:
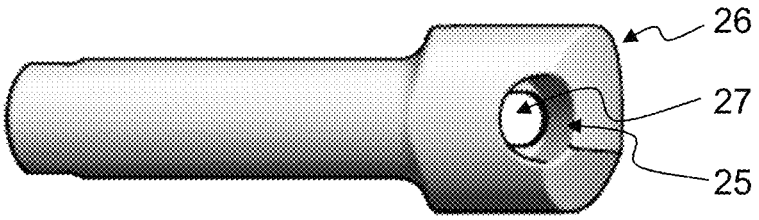
Figure 5C:
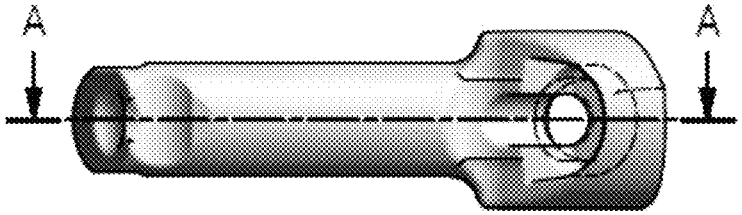
Figure 5D:
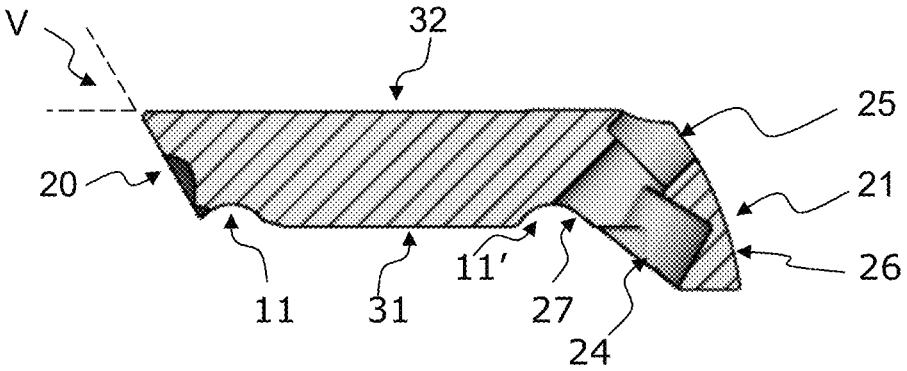
Figure 6:
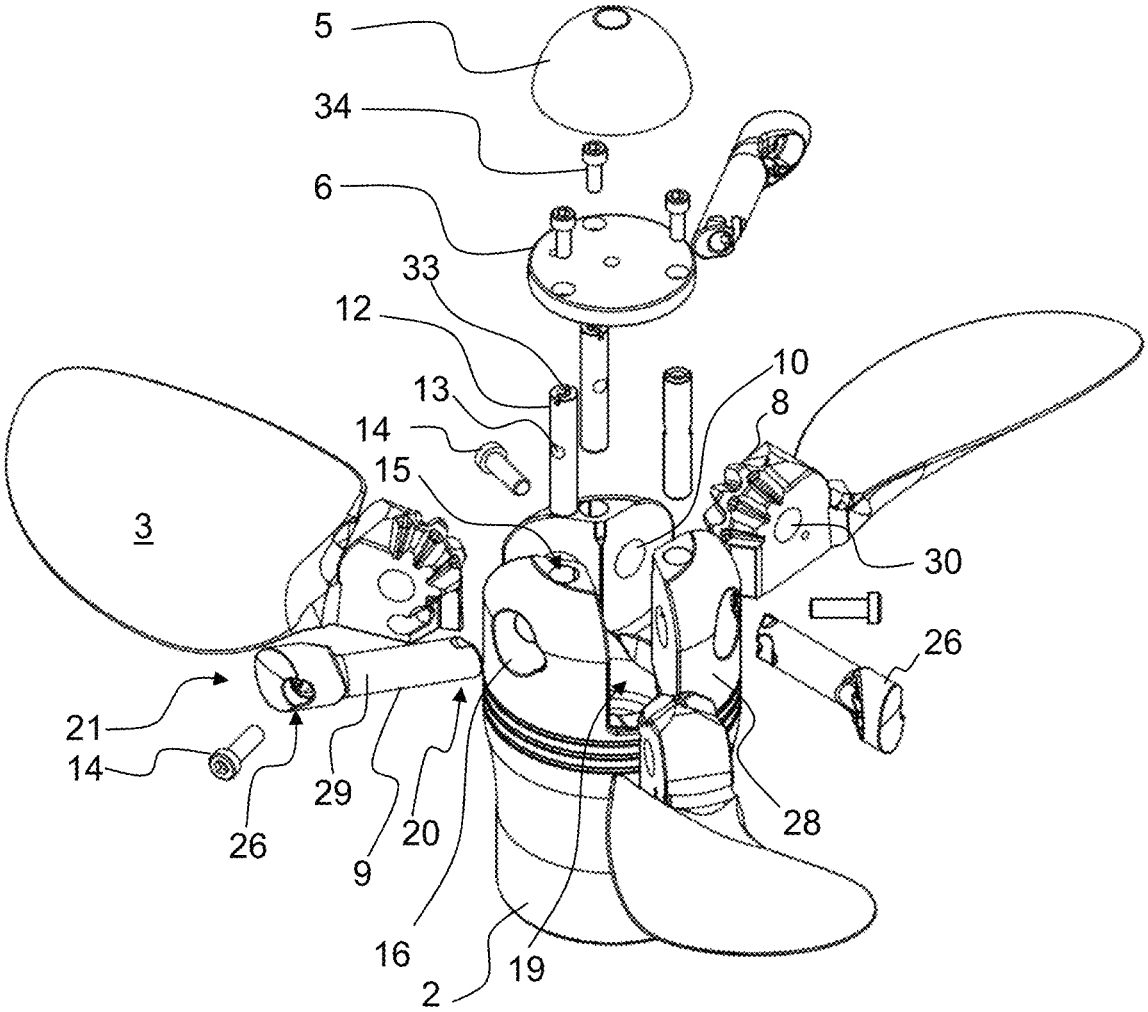
FIG. 6 shows a three bladed foldable propeller in an exploded view with the pivot pins of FIGS. 4 and 5.

As illustrated best in FIG. 5*d*, the stem of each pivot pin 9 has an outer side 32 that when mounted is facing outwards from the rotational axis of the propeller 1. An opposite inner side 32 is facing the rotational axis of the propeller 1 when the pivot pin 9 is mounted. The inner side 31 at the first end 20 comprise a first concavity 11 which when mounted is abutting a first side of a cross dowel 12. Each head 26 comprises a second concavity 11' which when mounted is abutting a second side of the cross dowel 12. As best seen in FIG. 4, this enclosure of the cross dowel 12 between the concavities 11, 11' prevents lateral movements of the cross dowel 13. FIG. 6 is an exploded assembly drawing. For mounting, the first ends 20 of the pivot pins 9 are each inserted into the hub 2 through apertures 16 in each of the three hub flanges 28. After insertion, the pivot pins 9 are extending across the slots 19, with the stem 29 extending through the aperture 30 of the blade root gear 8 of the propeller blade 3 (not shown in FIG. 6 but similar as in FIG. 2) and into the holes 10 of an opposite hub flange 28 and then further extending into the head 26 at the second end 21 of a neighboring pivot pin 9, behind the holes 10, as also illustrated in FIG. 4*a*. When all three pivot pins 9 are mounted with the propeller blades 3, the cross dowels 12 are inserted into the mating holes 15 of the hub, and the locking screws 14 are inserted through the holes 27 and screwed into the threaded holes 13 of the cross dowels 12. The recess 25 is accommodating the locking screw 14 head when the locking screw 14 is fastened.

The gears 8 at the blade root 4 comprises two oppositely arranged pinion gears for intermeshing with the neighbouring blades' pinion gears in order to synchronize the pivot movement of the plurality of blades 4 from an active orientation, when the propeller rotates, to an inactive orientation where the blades are oriented folded backwards parallel or quasi parallel to the axis of rotation of the propeller 1.

As best illustrated in FIG. 5*d*, the first end 20 of the pivot pin 9 is slanted at an acute angle V relatively to the stem 29 in order for the outer side 31 of the stem 29 being longer than the inner side 31 of the stem 29. As best illustrated in FIG. 4*a*, this first end 20 with the acute angel is used for giving passing-space for the stem 29 of another of the pivot pins 9 during insertion of the pivot pins 9 one after the other in the hub 2. As illustrated in FIG. 4*a* and FIG. 5*a*, the head 26 comprises an abutment cavity 24' that is abutting the outer side of the pivot pin 9 for holding the cavity 11 of the inner side 32 of the pivot pin 9 against the cross dowel 12.

The end cap 6 in FIG. 6 is fastened with screws 34, similarly as illustrated in FIG. 2, where the screws 34 are fastened into longitudinal threaded holes 33 at the top of the cross dowel 12. The anode 5 is fastened to the end cap 6 by a further screw.

Although, the embodiment has been shown and explained in a three-blade configuration, the principles can be used for more than three blades 3, for example four blades 3 or more. Four pivot pins 9 would then form a square instead of an equilateral triangle. Five pivot pins would form a pentagon.

Figure 7:
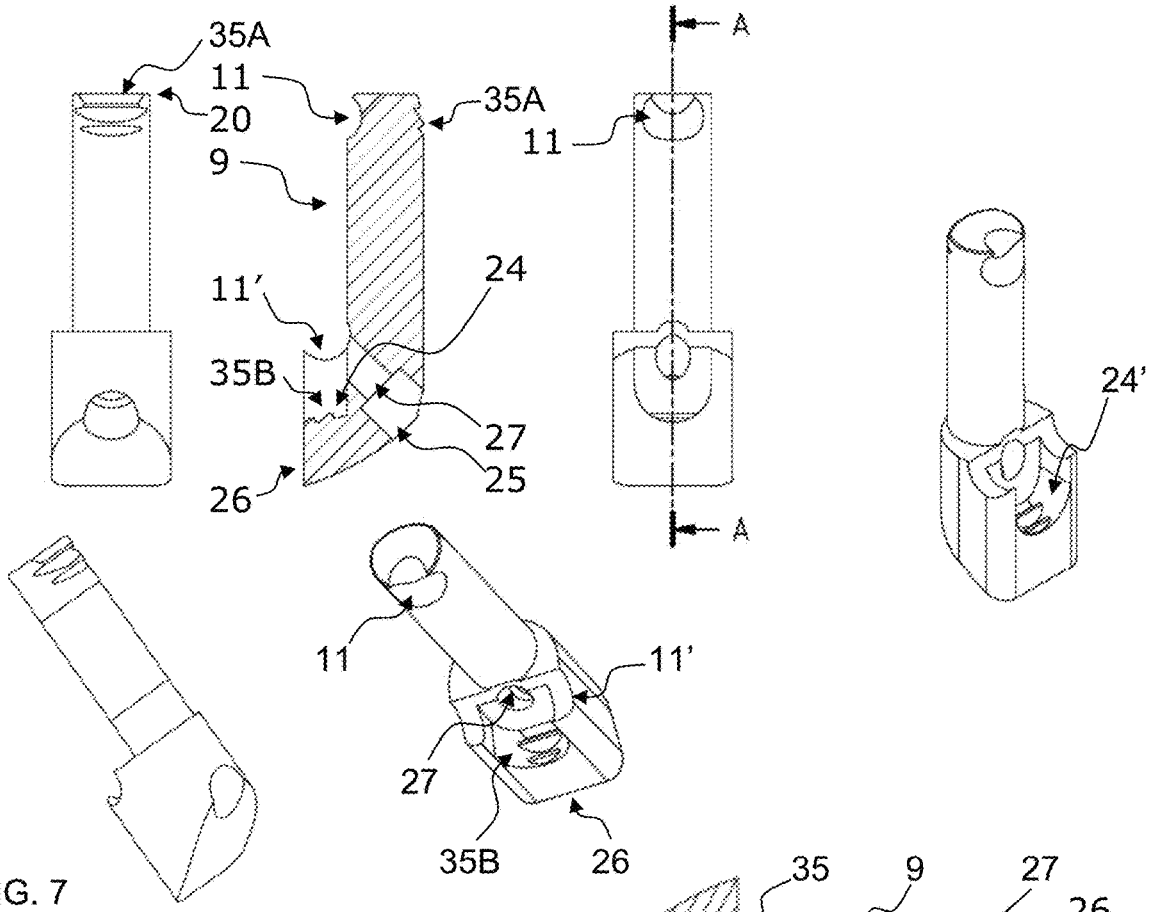
FIG. 7 illustrates different views of an alternative embodiment of the pivot pins with a notched interlock and configured for use with cross dowels.
Figure 8:
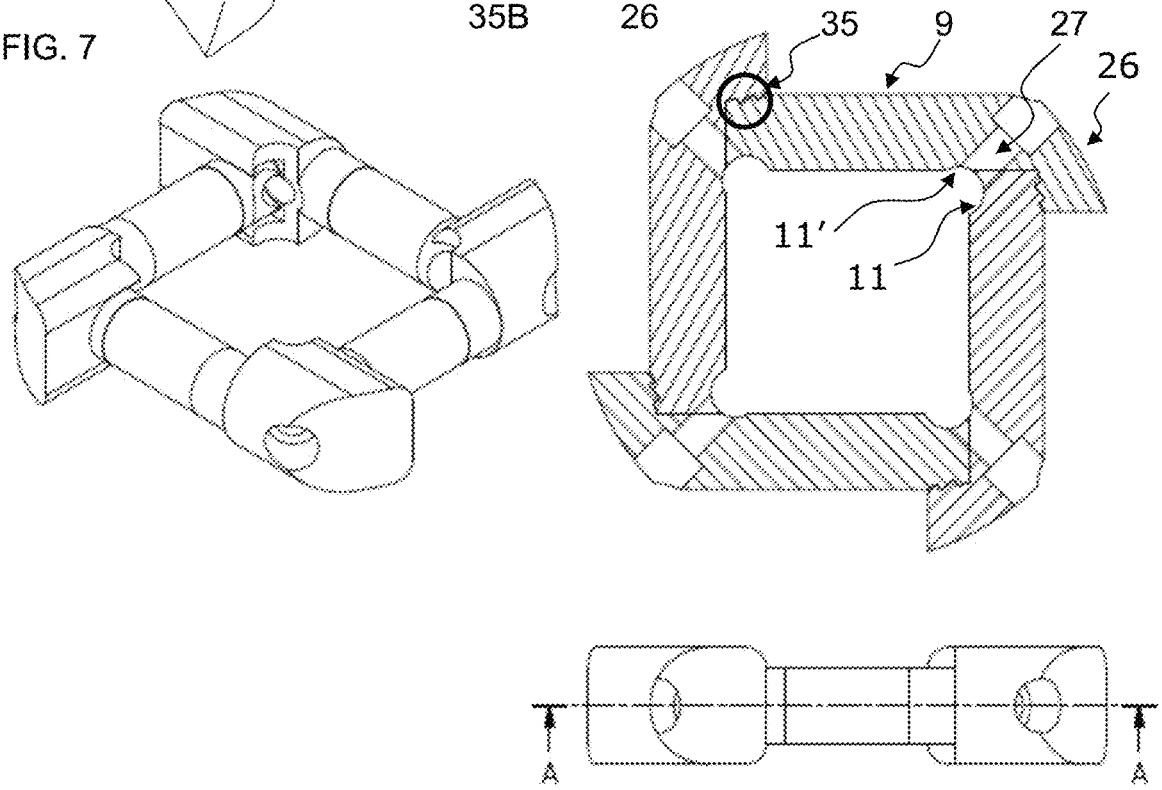
FIG. 8 illustrates different views of a square assembly with four pivot pins of the type of FIG. 7.

FIG. 7 illustrates different views of an alternative embodiment of a pivot pin 9 in which the first end 20 comprises a first part 35A, and the abutment cavity 24' in the recess 24 of the head 26 comprises a second part 35B of a notched interlock 35. In assembled form, such notched interlock 35 is illustrated in FIG. 8 for an embodiment of a square assembly of four pivot pins 9, although such interlock 35 is also workable for a triangular assembly of three pivot pins 9. In FIGS. 7 and 8 the notches and recesses of the interlock 35 are formed as barb-shaped ribs, which eases assembly when the first end 20 of one pivot pin 9 is pushed into the head 26 of a second pivot pin 9 in a corner of a triangular of square assembly of pivot pins 9.

Figure 9:
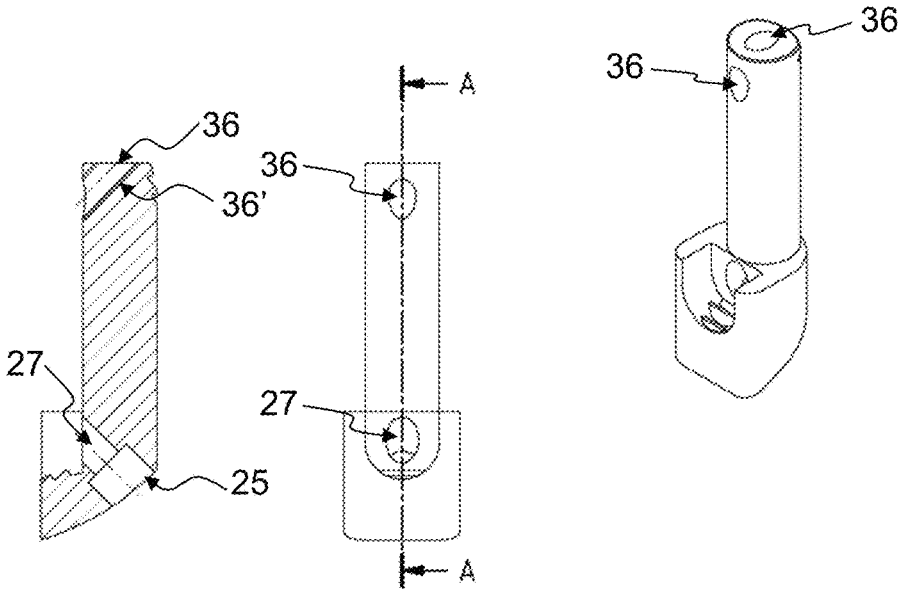
FIG. 9 illustrates different views of a further alternative embodiment of the pivot pins with a notched interlock similarly to the embodiment of FIG. 7 but configured for use without cross dowels.

FIG. 9 illustrates different views of an embodiment of a pivot pin 9, which is similar to the pivot pin 9 of FIG. 7, however, without the first concavity 11 for the cross dowel 12, but with a threaded screw hole 36 in the first end 20. Also, the head 26 of the pivot pin 9 is free from a second concavity 11' for a cross dowel. Instead, for stability of the square assembly of pivot pins 9, or similarly for a triangular assembly, the first end 20 of the pivot pin 9 comprises a hole 36 with an inner threading 36' for cooperation with the corresponding outer threading of the locking screw 14.

Figure 10:
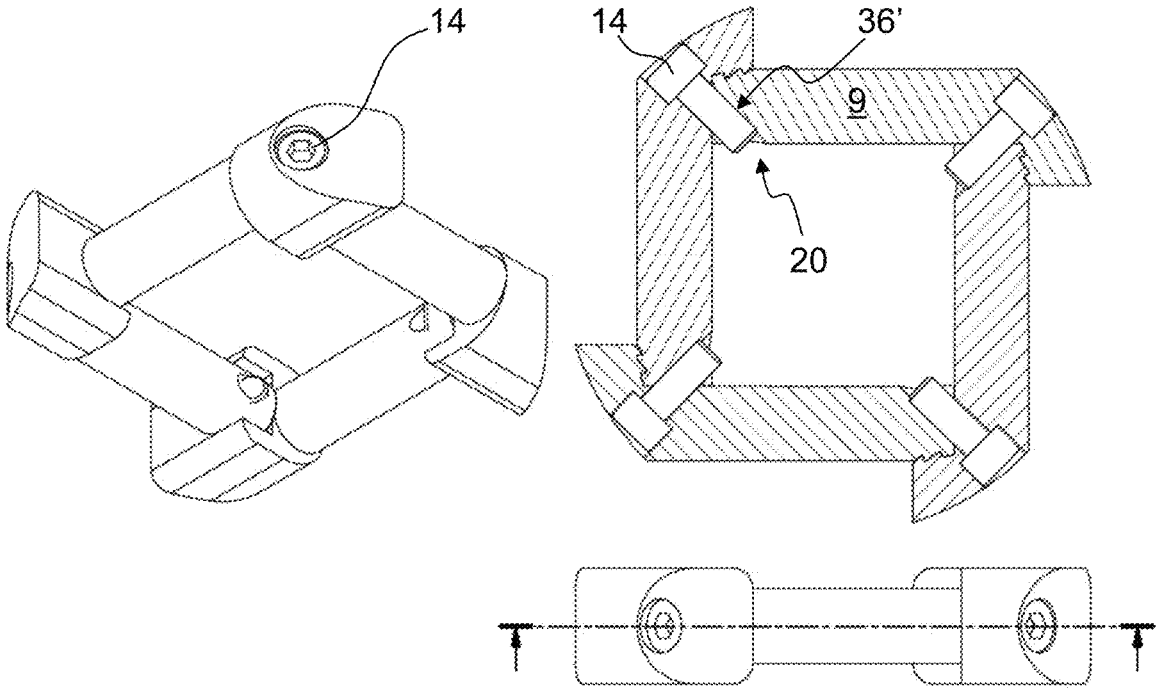
FIG. 10 illustrates different views of a square assembly with four pivot pins of the type of FIG. 9 where locking screws are fastened in threaded holes in the first ends of the pivot pins.

An exemplary assembled form is illustrated in FIG. 10 for an embodiment of a square assembly of four pivot pins 9, although the interlock 35 is also workable for a triangular assembly of three pivot pins 9.

Figure 11:
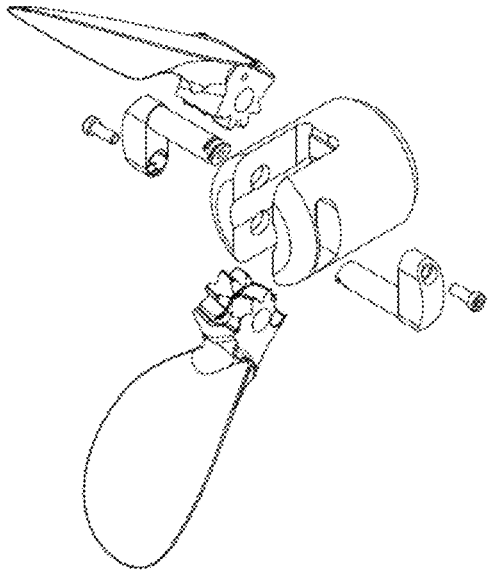
FIG. 11 shows a two bladed foldable propeller in an exploded view with the pivot pins of FIG. 12.
Figure 12:
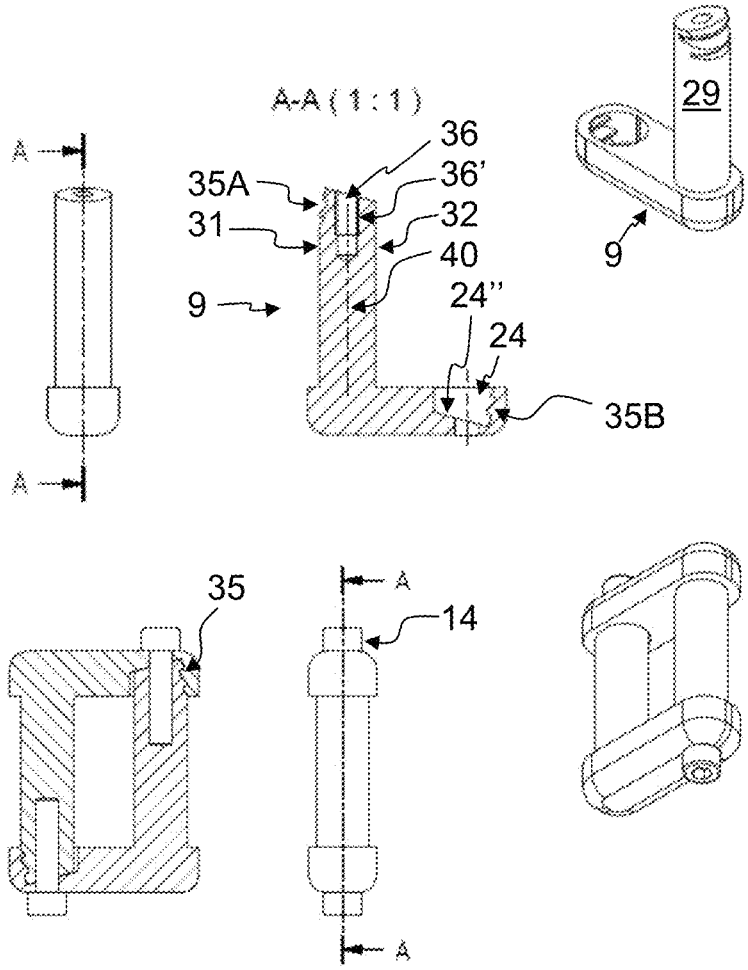
FIG. 12 illustrates different views of a further alternative embodiment of the pivot pins with a notched interlock for a two bladed foldable propeller of the type as in FIG. 12.

FIG. 11 shows a two bladed foldable propeller in an exploded view with the pivot pins of FIG. 12.

As illustrated in FIG. 12, the pivot pins 9 have a notched interlock 35, similarly to the embodiments of FIGS. 7-10. The bottom 24" of the pivot pin recess 24 is inclined relatively to the longitudinal axis 40 of the pivot pin 9. Correspondingly the first end 20 of the pivot pin 9 is slanted at an acute angle relatively to the stem 29 such that the outer side 31 of the stem 29 is longer than the inner side 32 of the stem 29 and, thus, fitting tightly into the pin recess 24 where the first end 20 of the pivot pin 9 is abutting the bottom 24" of the pivot pin recess 24. The slanted first end 20 of the pivot pin 9 acts as a wedge relatively to the second part 35B of the interlock 35 when the pivot pin 9 is inserted into the pivot pin recess 24 such that the first part 35A of the interlock 35 is secured in engagement with the second part 35B of the interlock 35.

The invention claimed is:

1. A foldable propeller for a boat, wherein the foldable propeller comprises a hub for directly or indirectly fastening to a driveshaft that is connected to a motor, the drive shaft defining a rotation axis and an axial direction; wherein the foldable propeller comprises a plurality of individual blades, where each of the blades comprises a blade root arranged to pivot around a corresponding pivot pin in the hub in order for the blades to be either in a first orientation, which is an operative orientation where each blade is extending from the blade root in a radial direction, or in a second orientation, which is an inoperative orientation where each blade is extending from the blade root in the axial direction; wherein the hub correspondingly comprises a plurality of hub flanges with a slot in between neighbouring hub flanges, each slot accommodating one of the blade roots; wherein each pivot pin comprises a stem between a first end and a second end, the stem extending through an aperture in the blade root in order for the blade with the aperture being mounted pivotal about the stem; each hub flange comprising a hole in which a first end of one of the pivot pins is accommodated and an aperture in which at least part of a second end of another of the pivot pins is accommodated such that each pivot pin extend from one of the hub flanges to another of the hub flanges, wherein the pivot pins are oriented in a plane perpendicular to the rotation axis of the propeller, wherein each of the pivot pins at its second end comprises a portion that is dimensioned larger than the first end, the portion forming a head with a recess that accommodates the first end of another of the pivot pins inside the head.

2. A foldable propeller for a boat according to claim 1, wherein the first end has a cross section that is equal to or smaller than a cross section of the stem in order for the first end to fit through the aperture in the blade root during insertion.

3. A foldable propeller for a boat according to claim 2, wherein the head has a larger cross section than the stem.

4. A foldable propeller for a boat according to claim 1, wherein the head and the stem are formed as a single integral piece.

5. A foldable propeller for a boat according to claim 1, wherein a cross dowel is provided for each head, each cross dowel comprising a threaded hole into or through the cross dowel; wherein the stem of each pivot pin has an outer side facing outwards from the rotational axis of the propeller and an opposite inner side facing the rotational axis of the propeller; wherein the inner side at the first end comprise a first concavity abutting a first side of one of the cross dowels; wherein each head comprises a second concavity abutting a second side of the cross dowel, thereby preventing movements of the cross dowel perpendicular to a longitudinal axis of the cross dowel while accommodated between the first concavity and second concavity.

6. A foldable propeller for a boat according to claim 5, wherein the head comprises a hole extending through the head, and wherein a locking screw extends through the hole and into a threading in the cross dowel.

7. A foldable propeller for a boat according to claim 5, wherein the recess in the head comprises an abutment cavity abutting the outer side of the another of the pivot pins for holding the cavity of the inner side of the pivot pin against the cross dowel.

8. A foldable propeller for a boat according to claim 7, wherein the first end of the pivot pin is slanted at an acute angle (V) relatively to the stem for the outer side of the stem being longer than the inner side of the stem for giving passing-space for the stem of another of the pivot pins during insertion of the pivot pins one after the other in the hub.

9. A foldable propeller for a boat according to claim 1, wherein each pivot pin at its first end comprises a first part of a notched interlock, and wherein the recess in the head of each pivot pin comprises an abutment cavity comprising a second part of the notched interlock; and wherein the abutment cavity of each of the pivot pins is abutting the first end of another of the pivot pins for cooperation of the first part and the second part such as to form the notched interlock with at least one recess and at least one notch in cooperation in the abutment cavity.

10. A foldable propeller for a boat according to claim 9, wherein the at least one recess and notch are formed as interlocking barb-shaped ribs.

11. A foldable propeller for a boat according to claim 1, wherein the head comprises a hole extending through the head for a locking screw extending through the hole, and the first end of the pivot pin comprises a corresponding hole with a threading for receiving the thread of the locking screw.

12. A method for assembling a foldable propeller for a boat according to claim 1, the method comprising, inserting a first of the pivot pins with its first end from an outer side of a first of the hub flanges into and through the aperture of the first hub flange; while the blade root is positioned with its blade root aperture inside the slot between the first hub flange and a second of the hub flanges, pushing the first end of the pivot pin through the blade root aperture of the root blade and across the slot into the hole of the second hub flange; repeating the procedure for the remaining blades and pivot pins; wherein the head of each pivot pin after insertion accommodates the first end of another of the pivot pins.

13. A method according to claim 12, further comprising inserting a cross dowels along a concavity in each of the heads, the cross dowel comprising a threaded hole; mounting and tightening a locking screw through a hole in each of the heads and into the corresponding threaded hole of the cross dowel.

14. A method according to claim 12, further comprising mounting and tightening a locking screw through a hole in each of the heads and into a corresponding threaded hole in the first end of the pivot pin.

* * * * *